United States Patent [19]

Imai

[11] 4,224,851

[45] Sep. 30, 1980

[54] KNOCKOUT FOR PUNCH SCRAP

[75] Inventor: Hiroto Imai, Fukuyama, Japan

[73] Assignee: Mitsubishi Jukogyo Kabushiki Kaisha, Tokyo, Japan

[21] Appl. No.: 919,165

[22] Filed: Jun. 26, 1978

[51] Int. Cl.[3] ..... B26D 7/00

[52] U.S. Cl. ..... 83/117; 83/113; 83/123; 83/127

[58] Field of Search ..... 83/113, 116, 117, 118, 83/119, 120, 123, 127

[56] References Cited

U.S. PATENT DOCUMENTS

| | | | |
|---|---|---|---|
| 2,037,469 | 4/1936 | Harless | 83/117 |
| 2,450,312 | 9/1948 | Tollison | 83/117 |
| 2,546,069 | 3/1951 | Hart | 83/116 |
| 2,736,380 | 2/1956 | Dillenburger | 83/118 |

*Primary Examiner*—W. Donald Bray
*Attorney, Agent, or Firm*—George B. Oujevolk

[57] ABSTRACT

A scrap knockout for use with a rotary punching apparatus includes a knife cylinder equipped with punch blades on the outer peripheral surface, and an anvil cylinder having a layer against which the blades are pressed, so as to punch a workpiece fed in between the two rotating cylinders. The scrap knockout is so arranged that each of the punch blades is formed with a cut or slot, and a scrap knockout lever is engaged with the cut or slot so as to be restricted in its upward and downward movements, with one end of the knockout lever is a free end located in the space surrounded by the punch blade and the other end is pivotally held by a punch blade support, so that the scrap formed by the punching can be removed by the upward motion of the lever.

2 Claims, 17 Drawing Figures

KNOCKOUT FOR PUNCH SCRAP

BACKGROUND OF THE INVENTION

This invention relates to improvements in the scrap knockout arrangement for removing scraps of a given shape formed by punching of a sheet material, such as sheets of corrugated board, on a rotary punching apparatus.

BRIEF DESCRIPTION OF THE PRIOR ART

Punching corrugated board sheets to desired contours is usually done by rotary punching machines. FIG. 1 schematically shows such an apparatus of conventional design. A stack of corrugated board sheets 1 on a feed table 3 are forced, one by one, into a pair of feed rolls 4 by a reciprocating kicker 2. With the rotation of those rolls, the sheets are fed in succession to a punching zone 5 and a scrap removal zone 6, so that they are punched in the zone 5 and the resulting scraps are removed from the punched sheets in the zone 6. The punching zone 5 comprises a knife cylinder equipped with a punch on its outer peripheral surface and adapted to rotate in a given direction at a predetermined speed, and an anvil cylinder so located as to mate with the knife cylinder and run contrariwise but at the same speed with the knife cylinder, the anvil cylinder being equipped with a member or layer on its outer peripheral surface against which the punch is to be pressed. Each sheet of corrugated board is punched (sheared) between the blades of the punch and the blade-receiving layer. Punching in this punching zone 5 is accomplished in either of two arrangements. One is called the hard cut method because, as illustrated in FIG. 2(A), the work is cut by plane blades forced against a blade-receiving member of steel. The other is the soft cut method which uses a combination of saw blades and a rubber-lining blade-receiving member, as in FIG. 2(B). In the former, the surface of an anvil cylinder 8 (which serves as the blade-receiving member) is surface hardened to prevent damage by the contact with the edges of plane blades 7. In the latter, the edges of the saw blades 10, which bite into the rubber-lining layer 11 of an anvil cylinder to cut off each sheet of corrugated board, will naturally damage the outer peripheral surface of the rubber-lining layer 11. This, in turn, will make the saw blades 10 dull, resulting in incomplete shearing of the corrugated board. For this reason, it is practice to vary the ratio of rotation of the knife cylinder 9 to that of the anvil cylinder 12 slightly, for example, to 49:50 while, at the same time, allowing the anvil cylinder 12 to shift its position axially with respect to the knife cylinder 9 so that the edges of the saw blades 10 may uniformly contact as wide an outer peripheral surface of the rubber-lining layer 11 as possible, instead of a limited, unchanged surface portion.

As stated above, the punching is performed generally in two different ways. In either case, the scraps formed by punching are not completely severed from the remainder of the corrugated board but are left behind in the punched sheet. This necessitates an additional step of scrap removal.

The methods for scrap removal are roughly classified into two. One uses, as shown in FIG. 1, a scrap removal zone 6 separate from a punching zone 5. The other is called a single-unit method in that the punching zone 5 accomplishes both punching and removal of the resulting scraps.

The arrangements usually used for the simultaneous punching and scrap removal are of the construction typically illustrated in FIG. 3. As shown, kickoff sponge rubber pieces 12 and 13 for separately forcing out the punched work and scrap, respectively, are attached to the surface of a punch 14 mounted on a knife cylinder. The sponge rubber pieces 12, 13 are of suitably chosen height and hardness to attain optimum amounts and rates of kickoff. This arrangement enables the punched sheet 15 and the scrap 16 to be separated as soon as they are forced out of the punch 14.

However, the existing single-unit arrangements involve the following difficulties:

(i) Because of the high feed rate of corrugated board sheets (usually in the range of about 2–3 m/sec), the separation of each punched sheet 15 and the resulting scrap must be completed within a very short period of time.

(ii) The thickness of corrugated boards (generally about 3 to 8 mm thick) which is greater than ordinary paper results, as indicated in FIG. 4, in a large relative out-of-phase distance S necessary for separating each punched work 15 and the scrap 16.

(iii) As shown typically in FIG. 5, the corrugated board consists of a front liner 17, a rear liner 18, and a fluted sheet 19 separating the two flat sheets. Consequently, the spaces between the component sheets tend to get the sheared edges of the board caught in each other, as in the portion B in the same Figure.

(iv) Especially with the soft-cut arrangement that employs saw blades, as shown in the portion C in FIG. 6, the sheared edges of the work and therefore of the scrap (as hatched) are serrated so loosely that the components, or front and rear liners and the corrugating medium of the board can easily get caught in each other.

These difficulties combine to hamper the separation of scraps from punched sheets of corrugated board, particularly where, as in FIG. 6, the sheet is so sheared and punched as to form end scraps 20 on the leading end facing the direction X of delivery and also form slot or hole scraps 21.

FIG. 7 shows a typical prior art arrangement of a scrap removal zone separate from the punching zone (FIG. 1). An upper cylinder 22, adapted to be driven in the same direction at the same speed as the knife cylinder of the punching zone, carries a scrap kickoff block 23 secured by suitable fastener means to the outer peripheral portion of the cylinder corresponding to the point where a scrap 16 to be removed passes. Opposite to the upper cylinder 22 is located a lower cylinder 24, which is covered with a layer of soft sponge rubber 25, so that the scrap 16 may be forced by the kickoff block 23 into the sponge 25 for subsequent removal. With this apparatus of the dual-unit type, so called because the punching and scrap removal zones are provided as separate units, it is necessary to deliver the punched sheet and the resulting scrap together, and therefore in an incompletely separated state, to the scrap removal zone. However, the punched sheet and the scrap once traped in the space surrounded by the blade edge in the punching zone naturally tend to separate from each other on their way to the next zone. This frequently results in unwanted dropout of the scraps during the transfer between the two zones and also in inefficient use of the scrap removal zone.

A seemingly effective countermeasure might be to provide, as indicated in the portion D in FIG. 6, nicks 26 as part of the cut separating the punched work and the scrap. However, such a measure is not practical because the scrap and the remainder of sheet partly joined by the nicks 26 would be rather difficult to separate for scrap removal.

The apparatus of the dual-unit type, comprising separate zones for punching and scrap removal, is costly and needs considerable space for installation. In addition, the assembling of the apparatus requires about twice as much labor and time as those of the single-unit type designed for simultaneous punching and scrap removal operations in one zone.

OBJECTS OF THE INVENTION

Thus, it is an object of the present invention to provide a scrap knockout for positively removing scraps from punch blades upon punching, which permits the punching by the single-unit type apparatus that does not require a large installation space, high cost, or much time and labor for assembling, while overcoming all the disadvantages of the apparatus of the type.

SUMMARY OF THE INVENTION

According to the invention, a scrap knockout is provided for use with a rotary punching apparatus which includes a knife cylinder equipped with punch blades on the outer peripheral surface, and an anvil cylinder having a layer against which the blades are forced, so as to punch a work piece fed in between the two rotating cylinders. The scrap knockout is so arranged that each of the punch blades is formed with a cut or slot, and a scrap knockout lever is engaged with the cut or slot to be thereby restricted in its upward and downward motion, with one end of the knockout lever being a free end located in the space surrounded by the punch blade and the other end pivotally held by a punch blade support, so that the scrap formed by punching can be removed by the upward motion of said lever.

The above and other objects, features, and advantages of the invention will become more apparent from the following detailed description taken in conjunction with the accompanying drawings, in which:

DETAILED DESCRIPTION

Figure 1:
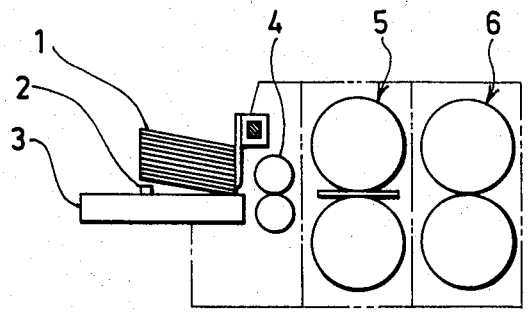
FIG. 1 (PRIOR ART)
FIG. 1 is a schematic general view of a conventional rotary punching apparatus.
Figure 2:
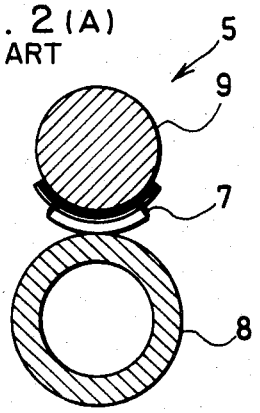
FIG. 2 (A) PRIOR ART
FIGS. 2(A) and (B) are sectional views of two different punching arrangements for the rotary punching apparatus.
Figure 2:
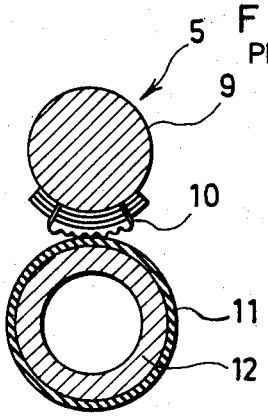
FIG. 2 (B) PRIOR ART
Figure 3:
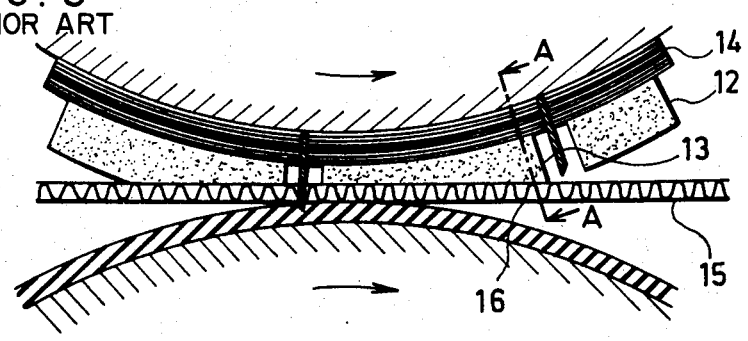
FIG. 3 PRIOR ART
FIG. 3 is a detailed sectional view illustrating one prior art method of separating the scrap formed by punching.
Figure 4:
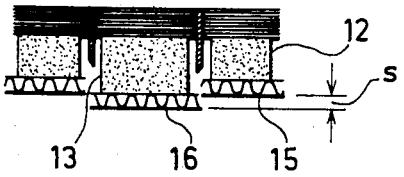
FIG.4 PRIOR ART
FIG. 4 is a sectional view taken along line A—A of FIG. 3.
Figure 5:
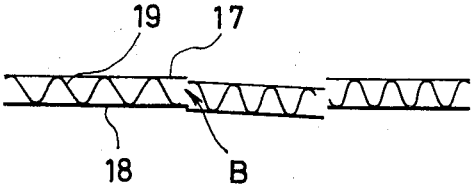
FIG.5 PRIOR ART
FIG. 5 is a sectional view of the sheared ends of a punched work and scrap formed by the arrangement of FIG. 3.
Figure 6:
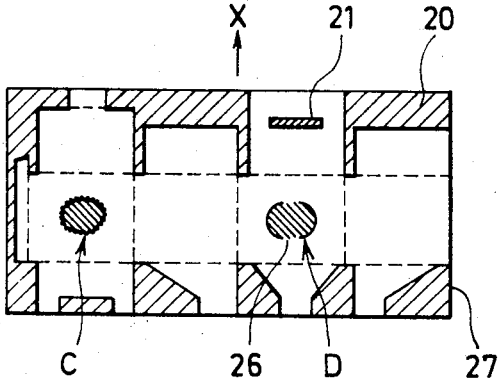
FIG.6 PRIOR ART
FIG. 6 is a plan view of a work punched by the arrangement of FIG. 3, indicating typical relations between the punched work and resulting scraps.
Figure 7:
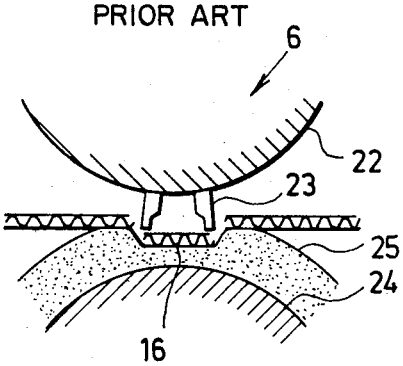
FIG.7 PRIOR ART
FIG. 7 is a detailed sectional view illustrating another prior art method of separating the scrap formed by punching.
Figure 8:
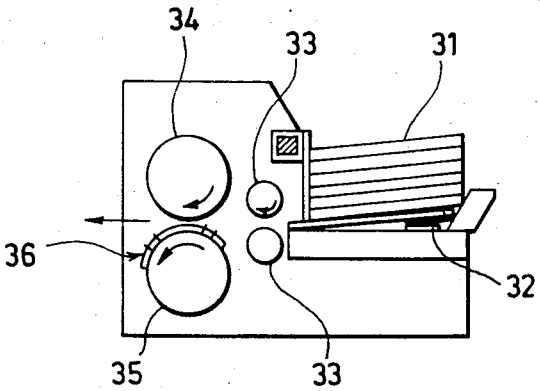
FIG. 8 is a schematic general view of a rotary punching apparatus embodying the invention.

The invention will now be described in detail in connection with an embodiment thereof illustrated in FIGS. 8 through 13. A number of sheets, for example, of corrugated board 31 are fed, one by one, from the bottom of the stack on a feed table into a pair of feed rolls 33 by a feed kicker 32 being driven to reciprocate by usua means. The feed rolls 33 coact to force each sheet of corrugated board 31 positively into a punching zone. The punching zone comprises a knife cylinder 35, a punch 36 mounted on the knife cylinder, and an anvil cylinder 34. The sheet of corrugated board 31 is punched to a desired shape by the punch 36 and the anvil cylinder 34.

Figure 9:
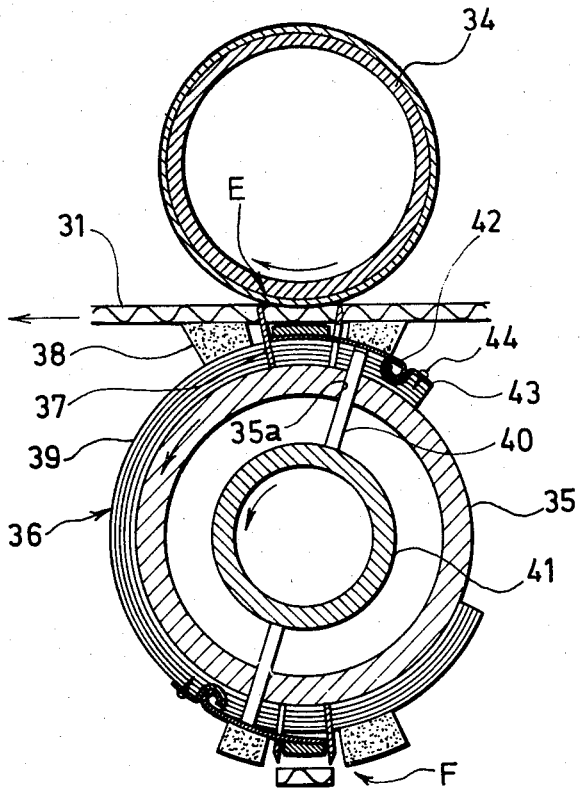
FIG. 9 is an enlarged sectional view of the punching zone of the apparatus shown in FIG. 8.
Figure 10:
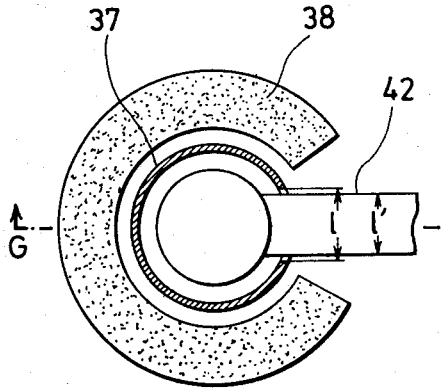
FIG. 10 is an enlarged plan view, in section, of the punch blade and associated parts of the punching zone of FIG. 9.
Figure 11:
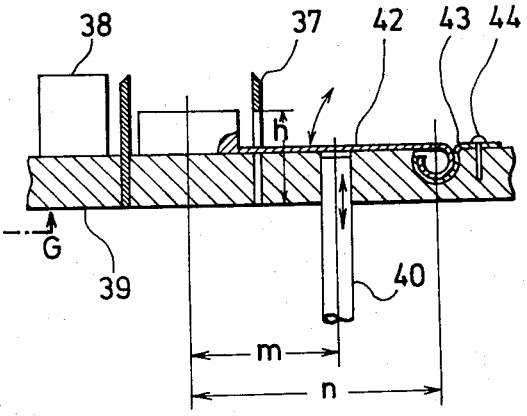
FIG. 11 is a sectional view taken along line G—G of FIG. 10.
Figure 12:
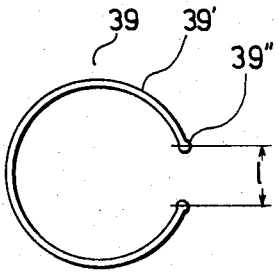
FIG. 12 is a plan view of a slot formed in the punch blade support of the punching zone.

As shown in FIG. 9, the knife cylinder 35 is hollow and is rotated in a given direction at a predetermined circumferential speed by a prime mover not shown. The anvil cylinder 34, in contact with the knife cylinder 35, is rotated contrariwise but at the same circumferential speed. The punch 36 is of the following construction. A blade support 39 attached around the knife cylinder 35 is formed with circular slots 39', in each of which a punch blade 37 is press fitted. Each blade 37 is surrounded by a piece of kickoff sponge 38 or the like secured to the blade support 39. A suitable number of such punch blades 37 and sponge pieces 38 are disposed over the blade support 39, at strategic points circumferentially and axially thereof depending upon the contour, size, and intervals of the portions of the work to be punched out. The knife cylinder 35 and the blade support 39 have corresponding through holes 35*a* formed at right angles to their axes and at appropriate intervals (e.g., about 50 mm apart) on the outer peripheries.

Figure 13:
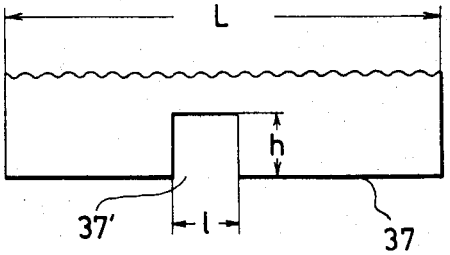
FIG. 13 is a fragmentary view of the punch blade.

Each punch blade 37 is formed with a square cut 37' made in the portion half set in the blade support 39, as indicated in FIG. 13.

Each of scrap knockout levers 42 extends through the cut 37' and terminates with a free end in the space surrounded by the blade 37. The other end of the lever is elastically fitted in and engaged with a recessed part of a fulcrum member 43. The scrap knockout lever 42 is adapted to turn up and back about the end at which it engages the recessed part of the fulcrum member 43, which member in turn is fixed to the blade support 39 by a fastener 44. A hollow push cylinder 41 is housed in the knife cylinder 35, with its center off that of the latter, and this eccentric cylinder rotates in the same direction at the same angular velocity as the knife cylinder 35.

Into each superposed set of the through holes 35a is loosely fitted a push rod 40 in radial direction for endwise movement. A plurality of such push rods are arranged at proper points axially and circumferentially of the knife cylinder 35, correspondingly to the number and locations of the scrap knockout levers 42 to be employed.

These push rods 40 are so designed as to move with the revolution of the knife cylinder 35, and is forced by the eccentric cam action of the push cylinder 41 to work as follows. When a given knockout lever is in the region E in FIG. 9, the associated push rod 4 is in contact, at its inner end, with the outer surface of the push cylinder 41, the outer end of the rod in the hole being sunken from the outer surface of the blade support 39. With the revolution of the knife cylinder 35 the knockout lever approaches the region F, when the push rod 4 is urged radially outward, with its outer end gradually emerging out of the hole and the surface of the blade support 39. This movement of each push rod 40 is effected by suitably choosing the length of the rod and the magnitude of eccentricity. The push rods 40 are made of lightweight material, e.g., a synthetic resin, and are smoothly finished on the surface so that they can easily slide endwise in the through holes 35*a*. As it protrudes from the surface of the blade support 39, each push rod 40 contacts and pushes the scrap knockout lever 42 radially away from the base support surface.

The punch 36 is set in place in the following way. First, each punch blade 37 is formed with a square cut 37′ of predetermined dimensions (width l and height h). (Refer to FIG. 13.) Next, pairs of holes 39″ are drilled in the blade support 39, in such a manner that the center-to-center distance of the resulting holes of each pair is the dimension l of a predetermined value. A jig saw usually employed for such purposes is introduced into either hole, and then the two holes are connected by a slot 39′ to receive a punch blade 37. (Refer to FIG. 12.) Following this slotting of the blade support 39, the blade 37 is forcefully fitted in the slot 39′ and is securely set in position. Then, from the distance m between the centers of scrap to be formed and the push rod 40, the length n of the scrap knockout lever 42 is suitably chosen, and the fulcrum member 43 is fixed at an end of the length n by a fastener 44. The square cut 37′ of the scrap knockout lever 42 is such that its width l is greater than the width l′ of the lever itself (FIG. 10) and its height h provides an ample allowance for the knockout lever 42 to be moved radially by the push rod 40. The numeral 38 indicates a kickoff sponge piece for forcing a punched work out.

With the construction so far described, the embodiment operates in the following manner. Each sheet of corrugated board 31 fed by the feed rolls 33 passes between the knife cylinder 35 and the anvil cylinder 34. During its delivery in the direction of an arrow, the sheet is punched by the punch blades 37 of the punch 36 mounted on the knife cylinder 35, against the anvil cylinder 34. The punched work is forced out by the elasticity of the kickoff sponge pieces 38 toward the next station for further fabrication.

Each scrap formed by punching is carried by that punch blade 37 revolving with the knife cylinder 35. As the scrap approaches the region F, the associated push rod 40 is gradually lifted by the eccentric cam action of the push cylinder 41, so that the outer end of the rod protrudes beyond the surface of the blade support 39 on the knife cylinder 35, thereby urging the scrap knockout lever 42 and therefore the scrap outward. With further rotation of the knife cylinder 35 the scrap reaches the region F, where it is released from the blade and falls onto a scrap conveyor not shown for delivery to some external collection point.

Before this punching unit returns to the region E with the rotation of the knife cylinder 35, the push rod 40 is reset axially to the initial position, and therefore the scrap knockout lever 42 is now free to be back to the surface of the blade support 39. Although the knockout lever 42 itself lacks any action of returning to the original position, it does return as it is forced against the blade support 39 by the scrap formed anew by the next punching in the region E.

The cycle just described is repeated to punch the sheet of corrugated board as desired and remove the scrap.

Figure 14:
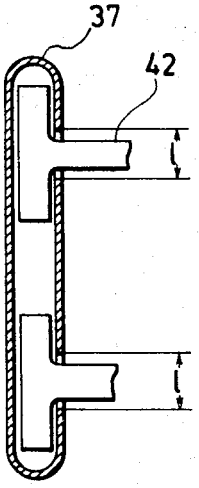
FIG. 14 is a sectional view of a modification to the embodiment shown in FIGS. 8 through 13, with two scrap knockout levers instead of one installed in the space surrounded by the punch blade.
Figure 15:
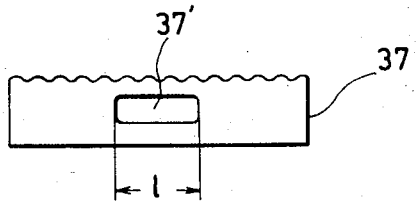
FIG. 15 is a view similar to FIG. 13 but showing a modified form of the punch blade.
Figure 16:
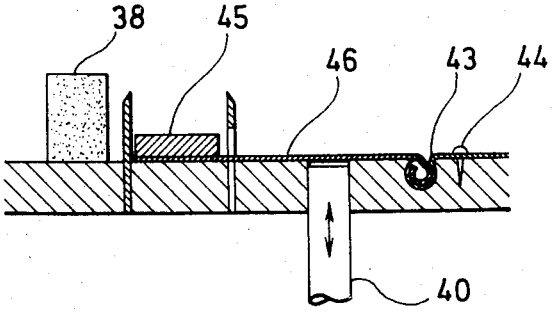
FIG. 16 is a view similar to FIG. 11 but showing a section through the modified form of the blade shown in FIG. 15.

While the cut 37′ in this embodiment has been described and illustrated in FIG. 13 as a square or rectangular cut open at the lower end of the blade 37, this is not a limitation to the invention. It may, for example, be a rectangular cutout or slot instead, formed in a suitable height of the blade 37, provided that the width is unchanged, as shown in FIGS. 15 and 16. In this case, the assembling problem that may arise from the impossibility of inserting the scrap knockout lever 45 through the slot 37′ will have to be solved, for example as indicated in FIG. 16, by dividing the lever into a scrap knockout pad 45 and a lever shank 46 and joining them together by bonding or other means upon conclusion of the punch fabrication. Where the circular punch blade 37 is too large or elongate in shape, two or more cuts or slots may be formed, with respective scrap knockout levers 42, as shown in FIG. 14.

Also, while the scrap knockout lever in the embodiment has been described as actuated by the push cylinder and the push rod, this is not a limitation, either. For example, the knockout lever itself may have elasticity that keeps it away from the blade support surface. Only during the process of punching it will be forced against the support surface by the nip pressure exerted between the anvil cylinder and the knife cylinder. As it is released from the nip pressure, the lever will curl up elastically from the backing surface, knocking out the scrap from the punch blade. The knockout lever may be pneumatically actuated instead, with a suitable portion on the inner side of the lever subjected to an air pressure biasing the lever away from the blade support surface. As another modification, the push rod may be timed in operation to slide hydraulically. Further, the push cylinder of the embodiment may be supplanted by a cam of an appropriate profile, and a cam follower be attached to the inner end of the push rod, so that the rod may be guided in its motion by the cam follower in sliding contact with the cam.

According to this invention, as has been described above, each scrap of a sheet material formed by punching is completely separated from the work and is positively removed from the space surrounded by the punch blade, by the upward motion of the knockout lever located in the space. Moreover, because each scrap is knocked out at a predetermined point, there is no trouble of random scattering and the scraps can be easily delivered out of the apparatus. The apparatus, of the so-called single-unit type in which the punch blade punches a work in the form of a sheet to a desired shape and, at the same time, the scrap released by the blade is knocked out, is less costly than the conventional dual-unit type, and it does not require a large space for installation.

What is claimed is:

1. A scrap knockout for use with a rotary punching apparatus, comprising in combination:

(a) a knife cylinder (35) with an outer peripheral surface;

(b) a blade support (39) attached around said outer peripheral surface;

(c) punch blades (37) held by and extending out of said blade support (39) with apertures (37') defined in said blades, said punch blades (37) defining a location for punched scrap;

(d) an anvil cylinder (34) disposed for cooperation with said knife cylinder (35) having a periphery against which the blades (37) are forced so as to punch a work piece fed in between said knife cylinder and said anvil cylinder; and, (e) a scrap knockout lever (42) pivoted at one end to said blade support (39), the other end being free, said lever (42) being so disposed as to pass through said aperture (37) which restricts the pivotal movement of said lever, said free end being located in said defined location, the formed scrap at said location being removed by the motion of said lever (42).

2. A scrap knockout according to claim 1, characterized in that a push cylinder is housed eccentrically in said knife cylinder, and said push rods are slidably disposed between said push cylinder and said knockout levers.

* * * * *